United States Patent [19]

Gattaz

[11] 4,022,518

[45] May 10, 1977

[54] ELECTRICAL ROTARY COAXIAL CONNECTOR

[76] Inventor: Yvon Gattaz, 6, rue Carnot, 93220 Gagny, France

[22] Filed: June 4, 1976

[21] Appl. No.: 692,661

[30] Foreign Application Priority Data

June 10, 1975 France ..... 75.18026

[52] U.S. Cl. ..... 339/8 R; 339/177 E

[51] Int. Cl.² ..... H01R 39/00

[58] Field of Search ..... 339/8 R, 8 PB, 6 R, 339/9 R, 9 RY, 5 R, 5 M, 177 R, 177 E

[56] References Cited

UNITED STATES PATENTS

| | | | |
|---|---|---|---|
| 3,408,610 | 10/1968 | Clarkson | 339/8 R |
| 3,683,320 | 8/1972 | Woods et al. | 339/177 E |

*Primary Examiner*—Roy Lake
*Assistant Examiner*—DeWalden W. Jones
*Attorney, Agent, or Firm*—Brisebois & Kruger

[57] ABSTRACT

Rotary electrical coaxial connector for high frequency transmission between a fixed and a rotating coaxial conductor. The fixed conductor comprises a first cylindrical section, a second cylindrical section of lesser diameter following the first section, conducting casings, and insulating layers. The rotary conductor is seated in a cylindrical section, external and internal shells, an insulating layer and a conducting layer.

9 Claims, 1 Drawing Figure

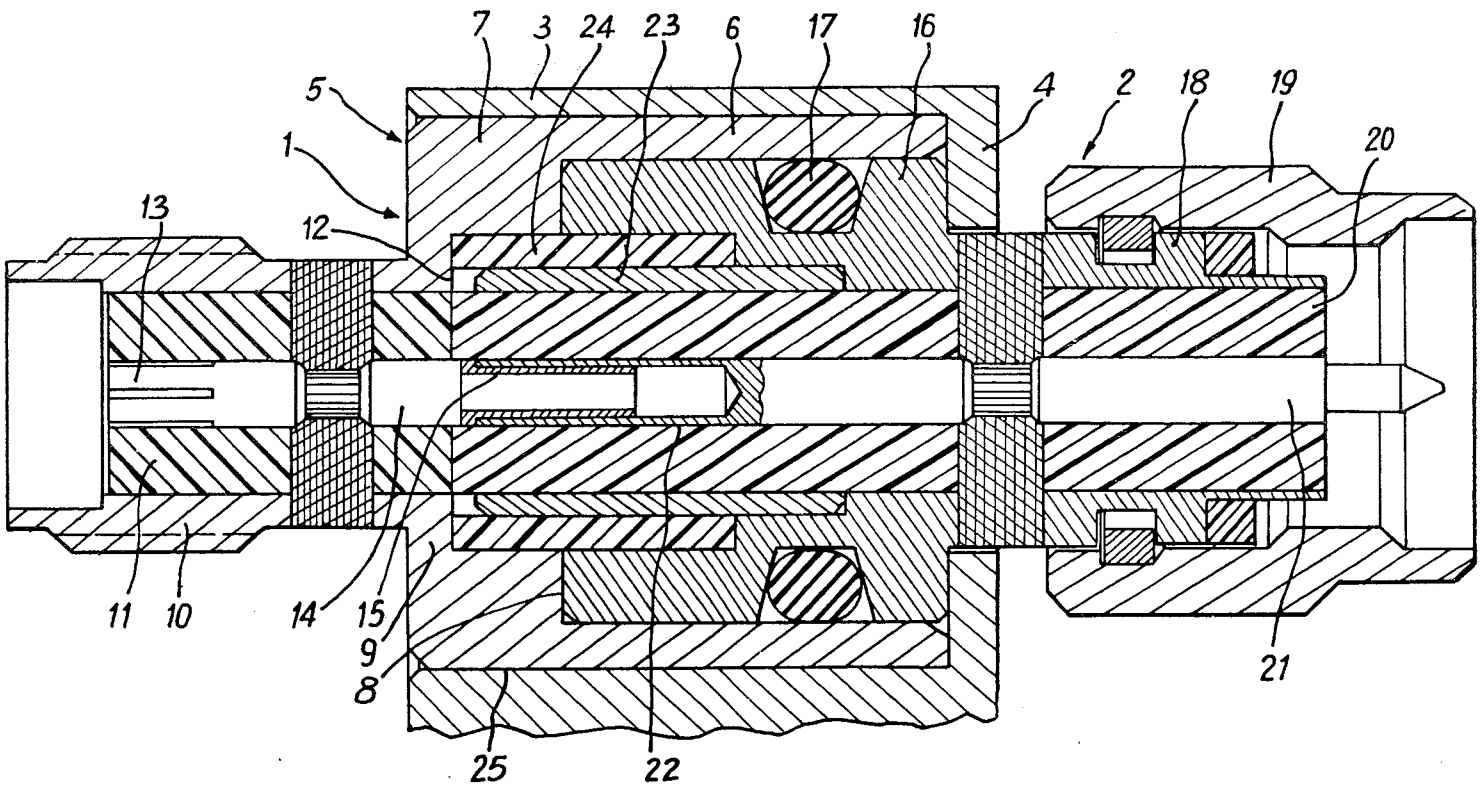
20
19
18
2
4
16
17
6
23
24
3
7
5
1
12
13
10
11
14
15
9
8
25
22
21

ELECTRICAL ROTARY COAXIAL CONNECTOR

SUMMARY OF THE INVENTION

The present invention relates to an electrical, rotary coaxial connector to provide the electrical continuity between a fixed cable and a coaxial cable which may be subjected to rotary motions, this connector being especially meant for very high frequency electical transmissions, for instance about 16 gigahertz.

The connector of the invention for instance may be used to provide electrical transmission from a coaxial conductor solidly mounted in a fixed part to a coaxial conductor solidly mounted in a part rotating with respect to the fixed one, the latter for instance being a missile body while the rotating one might be a missile aileron.

More specifically, the invention provides a high-frequency rotary electrical coaxial connector based on the principle of capacitive transmission and capable of withstanding climatic and mechanical stresses of large magitude and of performing a large number of rotations without deteriorating. Furthermore, the connector of the invention is meant to be of very low cost.

The object of the invention is an electrical rotary coaxial connector for high frequency transmission of wavelength $\lambda$ between a fixed coaxial cable or conductor and one capable of rotating with respect to said fixed cable, said connector comprising a fixed and a rotary part. The connector, fixed in a casing, comprises the following:

a circumferential conducting piece seated and kept in said casing and with a first cylindrical section, a thicker second cylindrical section of a lesser inside diameter following the first section, a very short internal shoulder following the first section, a very short internal shoulder at the end of the second section with a preferred length no more than one-tenth the length of said circumferential piece;

a conducting, outside-connecting casing extending said shoulder and preferably of one piece and continuous with it;

an insulating layer inside said shell;

an internal connecting conductor in said layer, and the second part comprising:

a circumferential conducting piece housed in rotary manner in said first cylindrical section and touching along all its length the inside cylindrical surface of said first section;

an external connecting and conducting shell of lesser diameter and preferably of one piece with and extending said circumferential conducting piece;

an internal conducting cylindrical shell solidly fixed to said rotary circumferential conducting piece and extending parallel to same and inside of it towards the shoulder of the other part;

an insulating layer in said conducting connector shell;

an internal conducting connector in said layer, the two internal conductors of the first and second parts extending through a pin-and-receptacle set, with a thin insulator about $\lambda/4$ thick, interposed between the external surface of the pin and the internal surface of the receptacle, the cylindrical shell and said conducting rotary circumferential piece being provided between them with an insulating shell which they touch over a length of $3\lambda/4$, said shell also touching the second cylindrical section and said shoulder over a length of $\lambda/4$, an insulating layer preferably of one piece with that of the second part being interposed between the pin-receptacle set and the conducting circumferential piece rotating with its shell.

It will be understood that in this manner one obtains a rotary bearing between the cylindrical inside surface of the first section of the circumferential conducting piece housed in the casing and the cylindrical surface corresponding to the rotary conducting circumferential piece which takes up the whole of the length of this piece, so that this bearing is of maximum length permitting maximum mechanical properties and life for this rotary connector. Further, all of the circumferential conducting piece of the first section may be housed inside said casing, and, in conformity with an advantageous characteristic of the invention, this casing may be provided at the end of said circumferential piece with a base engaging a rear surface of the rotary circumferential piece of the second part so as to create in this manner an axial stop. Another axil stop is obtained through the contact of a front end of said circumferential piece of the second part and the base separating the first and second sections of the first part.

It is understood that in these conditions the thickness of the shoulder connecting the conducting circumferential piece of the first section to its connecting receptacle may be extremely thin so that appreciable length remains available to the first section of this circumferential piece of the first part to thus ensure an increased rotational support.

In a variation of the invention, the cylindrical surface of the conducting circumferential piece of the second part may comprise an annular groove seating a hermetic seal, said groove being in an intermediate zone of that surface so as to keep on both sides of the groove sizable contact surfaces between said circumferential piece of the second part and the inside surface of the circumferential piece of the first part.

Advantageously the casing may be fastened to the first part by screwing, crimping or by clamping to the outside surface of the second section of the conducting circumferential piece of the first part.

Other advantages and characteristics of the invention will become apparent from the description below which is illustrative only and implies no restrictions, and by referring to the attached drawing in which the single FIGURE shows an axial section of a rotary connector of the invention.

The connector of the invention comprises a first part designated in its entirety by 1 and a second part designated in its entirety by 2, part 2 being capable of rotating within part 1. It will be observed that part 1 is housed in a casing 3 comprising a cylindrical inside surface and terminating in a base 4 of cuprous alloy. A conducting circumferential piece of the first part, for instance made of a cuprous alloy is housed inside this casing and solidly fastened to it, said piece in its entirety being denoted by 5. This circumferential piece comprises a first cylindrical section 6 taking up more than two thirds of the total length of piece 5. This section 6 extends by a second section 7 which is separated from section 6 by an annular ring 8. Section 7 terminates in a shoulder 9 and it will be noted that its length in the axial direction is less than one tenth the overall length of piece 5.

Shoulder 9 continues as a conducting shell 10 provided with conventional means for hooking up to the coaxial connector. An insulating layer 11 is located inside shell 10 which extends to the internal surface 12 of shoulder 9. It will be observed furthermore that an internal conductor 13 provided with connecting means for a coaxial conductor is located inside said layer and is extended by a pin 14 surrounded over part of its length by a thin insulating film 15, for instance polytetrafluoroethylene. The length of this insulating film is approximately equal to λ/4 for a frequency falling for instance between 15.5 and 16 gigahertz.

The second part 2 is provided with a steel conducting circumferential piece 16 of which the outside cylindrical surface touches the cylindrical inside surface of section 6 over its entire length except for an annular groove holding a hermetic seal 17. Furthermore, the rear side 16 of this piece touches shoulder 4 so as to form an axial stop. The front side of piece 16 touches the corresponding side of section 7 so as to form an axial stop in the other direction.

Piece 16 extends to the rear into a shell 18 which so functions together with a connector ring 19 that it can receive a coaxial connector. Inside shell 18 is located an insulating layer 20 extending forward until it touches to the front of insulating layer 11. The inside of layer 20 houses an internal conductor 21 forming at its front end a receptacle 22 seating pin 14 together with its coating of polytetrafluoroethylene 15, whereby capacitive coupling is established between pin 14 and receptacle 22.

It will be seen furthermore that around the lower part of layer 20 is located an elongated cylindrical shell 23 parallel to piece 16 towards shoulder 9. A cylindrical shell 24 of polytetrafluoroethylene fastened to the inside surface of section 7 is located between shell 23 and the front part of piece 16. The length of contact between the inside surface of section 7 and the inside radial surface of shoulder 9 with this shell 24 is about λ/4 when the axial length of contact between shells 23 and 24 increased by the length of contact between shell 24 and the corresponding surface of piece 16 is about 3λ/4.

Capacitive coupling between piece 16 and its shell 23 on one hand and the conducting circumferential piece 5 is thus achieved.

Connection between casing 3 and piece 5 for instance may be accomplished by crimping or clamping at the level of the outside surface of section 7.

The different pieces of part 2 are mounted in friction slides with respect to the corresponding pieces of part 1, thereby allowing easy rotation of part 2 in part 1.

It will be understood that the invention creates a rotary connector in which the bearing surface between pieces 16 and 5 extends over the maximum possible length, considering furthermore that the total bulk, to wit, the axial length of piece 5 increased by the thickness of the base 4 is limited by practicality, and that the length of section 7 can hardly be decreased because of the requirements of the capacitive coupling.

This appreciable length of the contact surface between pieces 16 and 5 therefore allows a significant improvement in the properties relating to resistance and to life in the connector of the invention. Thus, connectors of the invention have been subjected to more than 1,200 rpm at −40° C and at +70° C and to an axial stress of 10 Newtons and a transverse stress of 20 Newtons without becoming defective.

It will be further noted that according to the invention, the total bulk taken up by the connector diameter remains limited within twice the diameter of the connector part 10. Nevertheless the axial stops between piece 16 and base 4 on one hand and section 7 on the other are sufficient to provide good mechanical service.

It will of course be appreciated that the embodiment hereinbefore described has been given purely by way of example and may be modified as to detail without departing from the basic principles of the invention.

What is claimed is:

1. Rotary electrical coaxial connector for high-frequency transmission of wavelength λ between a fixed coaxial conductor and a coaxial conductor capable of rotating with respect to said fixed conductor, said connector being provided with a fixed part and a rotating part, characterized in that one of said parts, fixed in a cylindrical casing (3), comprises:

a circumferential conducting piece (5) seated and kept in said casing (3) and comprising a first cylindrical section (6), a second cylindrical section (7) which is thicker and of lesser inside diameter and which follows the first section, and a very short inside shoulder (9) at the end of the second section (7);

an outside conducting casing connector (10) extending said shoulder;

an insulating layer (11) in said casing (10);

an inside connecting conductor (13) in said layer; and in that the second part comprises:

a circumferential conducting piece (16) seated in rotary manner in said first cylindrical section (6) and touching along its entire length the inside cylindrical surface of said first section;

an external conducting connector shell (18) of lesser diameter;

an inside conducting cylindrical shell (23) solidly and rigidly connected to said rotary conducting circumferential piece (16) and extending parallel to same and on the inside towards the shoulder of the other part;

an insulating layer (20) in said conducting connector shell (18);

an inside connecting conductor (21) in said layer (20), the two inside conductors of the first and second parts extending by a complementary set of pin-receptacle (14,22) with interposition between the respective outside and inside surfaces of pin and receptacle of a thin insulating film (15) the length of which is essentially equal to λ/4, the cylindrical shell (23) and said rotary conducting circumferential piece (16) seating between them an insulating shell (24) with which they make contact over a length of 3λ/4, said insulating shell (24) also making contact with the second cylindrical section (7) and said shoulder (9) over a length of λ/4, an insulating layer (20) being placed between the pin-receptacle set (14,22) and the rotary, condcuting circumferential piece (16) with its shell (23).

2. Connector as defined in claim 1, characterized by the length of the inside shoulder (9) being no more than 1/10 that of said piece of the first part (5).

3. Connector as defined by claim 1, characterized by said casing (3) being provided at one of its ends with a base (4) touching a rear-base surface of the rotary circumferential piece (16) to form an axial stop.

4. Connector as defined by claim 1, characterized by the front end (8) of the rotary circumferential piece (16) stopping against a base separating the first section (6) and the second section (7) of the first part.

5. Connector as defined by claim 1, characterized by the rotary circumferential piece (16) comprising a groove seating a hermetic seal (17) in an intermediate zone, the surface of said piece offering large contact zones with the circumferential piece (5) of the first part on either side of said groove.

6. Connector as defined by claim 1, characterized by the fastening of casing (3) to the first part being effected by connection at the level of the outside surface of the second part (7) of the circumferential piece (5) of said first part.

7. Connector as defined by claim 6, characterized by casing (3) being clamped or crimped onto said conducting circumferential piece (5) of the first part.

8. Connector as defined by claim 1, characterized by the first section (6) of circumferential piece (5) of the first part being essentially as long as the length of the circumferential piece (16) of the second part and larger than two-thirds of the total length of said circumferential piece (5) of the first part.

9. Connector as defined by claim 1, characterized by the spatial requirements of the diameter of the circumferential piece (5) of the first part being less than twice the diameter of the connecting shell (10) extending said piece.

* * * * *

UNITED STATES PATENT AND TRADEMARK OFFICE

CERTIFICATE OF CORRECTION

PATENT NO. : 4,022,518

DATED : May 10, 1977

INVENTOR(S) : Yvon Gattaz

It is certified that error appears in the above-identified patent and that said Letters Patent are hereby corrected as shown below:

[73] Assignee: Societe Anonyme dite: Radiall

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*